US010099843B2

(12) United States Patent
Giordano

(10) Patent No.: US 10,099,843 B2
(45) Date of Patent: Oct. 16, 2018

(54) CLICK-IN VALVE

(71) Applicant: Gabriel Giordano, Buenos Aires (AR)

(72) Inventor: Gabriel Giordano, Buenos Aires (AR)

( * ) Notice: Subject to any disclaimer, the term of this patent is extended or adjusted under 35 U.S.C. 154(b) by 0 days.

(21) Appl. No.: 15/075,904

(22) Filed: Mar. 21, 2016

(65) Prior Publication Data

US 2016/0272407 A1 Sep. 22, 2016

(30) Foreign Application Priority Data

Mar. 19, 2015 (UY) ..... 36.038

(51) Int. Cl.

| | |
|---|---|
| ***B65D 83/42*** | (2006.01) |
| ***B65D 83/44*** | (2006.01) |
| ***B65B 31/04*** | (2006.01) |
| ***B65D 83/54*** | (2006.01) |

(52) U.S. Cl.

CPC ..... *B65D 83/425* (2013.01); *B65B 31/04* (2013.01); *B65D 83/44* (2013.01); *B65D 83/54* (2013.01)

(58) Field of Classification Search

CPC ..... B65D 83/205; B65D 83/425; B65D 45/32
USPC ..... 141/3, 20; 222/635; 215/224; 29/453
See application file for complete search history.

(56) References Cited

U.S. PATENT DOCUMENTS

| | | | | |
|---|---|---|---|---|
| 3,806,005 | A * | 4/1974 | Prussin | B65D 83/14 222/402.1 |
| 3,907,169 | A * | 9/1975 | Gortz | B65D 83/14 222/95 |
| 3,977,576 | A * | 8/1976 | Amabili | B65D 83/48 222/402.1 |
| 5,320,255 | A * | 6/1994 | Stoffel | B65D 83/38 222/212 |
| 6,170,537 | B1 * | 1/2001 | Lasserre | B65D 83/425 141/20 |
| 6,196,275 | B1 * | 3/2001 | Yazawa | B65B 31/003 141/18 |
| 7,124,788 | B2 * | 10/2006 | Pericard | B65B 31/003 141/20 |

* cited by examiner

*Primary Examiner* — Timothy L Maust
*Assistant Examiner* — Timothy P Kelly
(74) *Attorney, Agent, or Firm* — Muncy, Geissler, Olds & Lowe, P.C.

(57) ABSTRACT

System and parts for fast filling of containers, like aerosol containers, in which a valve is fixed into the container by being clicked-in and does not need a mounting cup. A mouth of the container extends toward the inside of the container with a sharp or rounded edge, in which pressurizing propellant is filled when passing between the valve and a wall of the container when overcoming the resistance of an external lip gasket.

8 Claims, 8 Drawing Sheets

Phase 1: centering clincher with container

Phase 2: pre click

Phase 3: clincher in final position

CLICK-IN VALVE

BACKGROUND OF THE INVENTION

An aerosol in general consists of following components: An aerosol can, containing a mixture of liquid and gas and an aerosol valve, for dispensing the content of the container. The standard aerosol valve (FIG. 7) consists of a mounting cup (crimped to the common one inch can opening), body, stem, inner gasket, outer gasket, spring, dip tube and actuator.

Gas filling to pressurize the aerosol is done trough the center hole of the mounting cup/stem entering into the inside of the container. Other possibilities of gassing are known as under cup gassing, when lifting the mounting cup during the gassing operation before clinched onto the can opening.

Similar systems or inventions may cover also valve holders clicked into the can opening curled towards the in- or outside, but always gassed through the valve.

SUMMARY OF THE INVENTION

This invention does not need a mounting cup and gas filling is neither done only through the valve, nor "Under-cup". This invention covers the high speed gassing process, passing by a special valve holder, called clincher.

Additionally this invention covers a special design of the upper part of the can, containing the pressurized fluid. The upper part of the can, the so called dome, in general is produced with an circumferential in- or outside curled one inch opening, in order to hold the mounting cup or to fix other valve holding possibilities. This invention covers the formation of a new profile of the can dome opening to the inside of the can and ending with a circumferential sharp or rounded edge, in order to give a strong fit to fingers of the clincher.

In addition, this invention covers a clincher containing standard aerosol valve components. The clincher including the outer special gasket formed on the clincher body forms part of this invention. The fit of the aerosol valve components (stem, inner gasket, spring and dip tube) containing body is not essential and only has to resist the pressure during actuation of the aerosol valve. The clincher produced out of plastic material is formed with flexible fingers with supports on each of the finger, which are clamping around the sharp or rounded edge of the can opening, which is formed to the inner side of the aerosol can. When the clincher is mounted onto the can opening, he forms with his fingers an irrevocable fit of the valve on the can. No clinching process deforming the metal is needed. The system only generates a "click" when mounted onto the container.

Additionally this invention covers the special formed outer gasket, which is part of the clincher. This outer gasket is formed with a one side inner opening, securing the bypass of the gas during the gassing process and then the tight sealing with the gasket lip to retain the pressurized filling inside the can.

The filling process described as follows, requires only small changes to the fillers lines: The can with the special inside opening of the dome hole diameter (not limited to one inch opening only) is filled with the liquid content of the required product. Then the clincher, containing all valve components, is mounted by a click-into the can. The gassing will be done bypassing the clincher at the inner-formed can opening. The special formed gasket secures the gassing process into the can and also secures the pressurized fluid to be kept in the can.

Summarizing this invention, all above mentioned components form an integral part of this new invented system. The can opening formed towards the inside with a sharp or rounded circumferential edge, the clincher with the fingers fixing the valve onto the can and the special formed gasket, securing only the gassing and retention of the pressurized liquid in the can, guarantees a new way of a high speed gassing process, yet not known to the international world market.

The advantages of this new dispensing system are as follows:

- Fast gassing. Faster than any existing valve invention, gassing the system with the valve already fixed to the can. This secures a solution to actual problems, as gassing speed and productivity of the process.
- No mounting cup, therefore no crimping operation in order to fix the valve body to the cup needed and avoiding known problems
- No mounting cup/can clinching, avoiding known problems
- Cost savings in replacing metal cups with plastic closure (clincher)
- Cost savings in using in-house injection molding machines for the production of the clincher
- Cost savings in using in-house injection molding machines for the production of the special outer gasket
- Cost savings on components by using smaller can dome opening, as no crimping nor clinching is needed
- No metal nor plastic mounting cup nor outer gasket needed
- Existing valve systems (body, inner gasket, stem, spring, dip tube and actuator) can be used by existing valve suppliers
- Components as clincher and special gasket can be produced by existing valve suppliers
- Only small changes to the assembly lines, gassing heads and valve to can click-in system at fillers to be done
- Easy tool change at can producers when drawing the inner dome hole towards the inside of the can

BRIEF DESCRIPTION OF THE DRAWINGS

Below detailed description of the invention summarized as following in attached drawings.

DETAILED DESCRIPTION OF THE INVENTION

Figure 1:
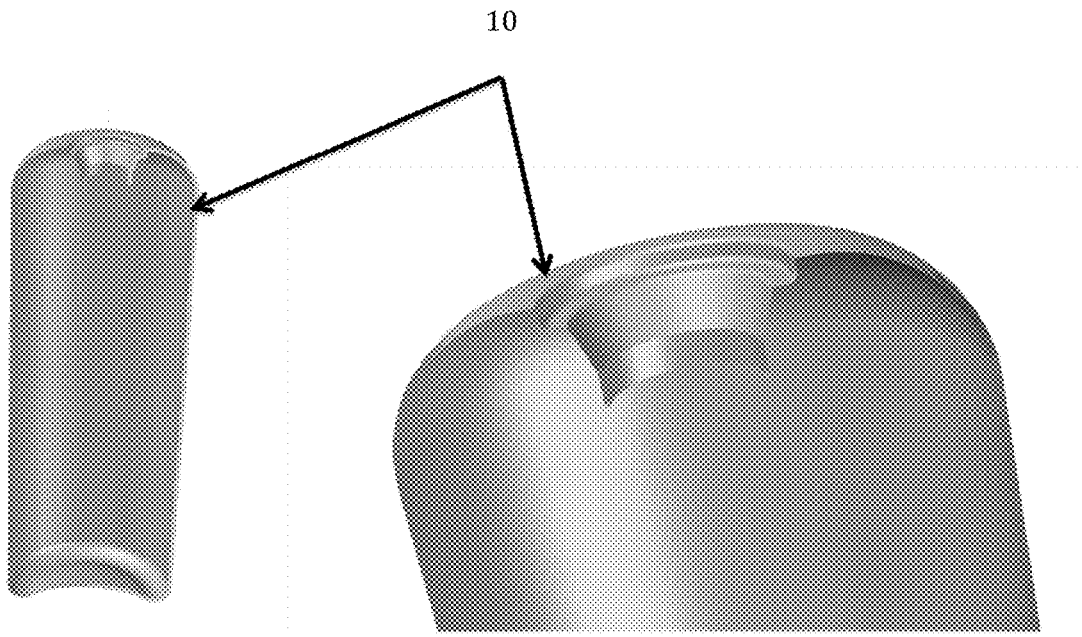
FIG. 1 shows a 3D cross-section view of the aerosol container.

A) Aerosol Container FIG. 1:

Todays aerosol cans consist in general of one, two or 3 parts. A three part can consist of a bottom part, a side part and an upper part, called dome. The two-part can consist of a side part including already the bottom part, and an upper part, called dome. A one part can consist of a container already including all three before mentioned parts.

This invention concentrates on the upper open part of the can or container, the dome. The opening in the center of the dome as shown in FIG. 1 may be round, square or with more edges. During production of the dome or the complete aerosol can, this opening is drawn downwards, towards the inner side of the aerosol container or can (10) ending with a circumferential rounded or sharp edge in order to give a strong hold to the "Clincher".

Figure 2:
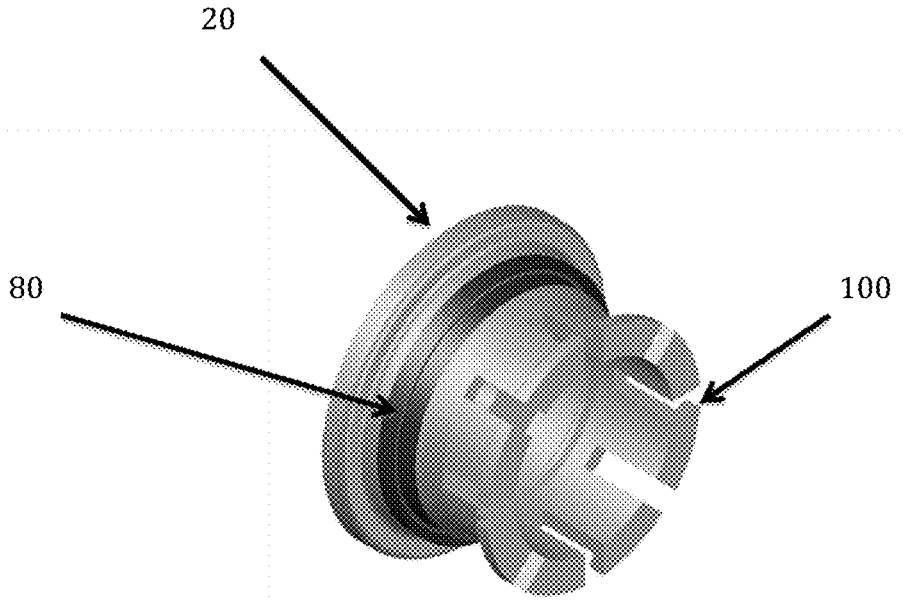
FIG. 2 shows a 3D view of the clincher including clincher gasket.
Figure 3:
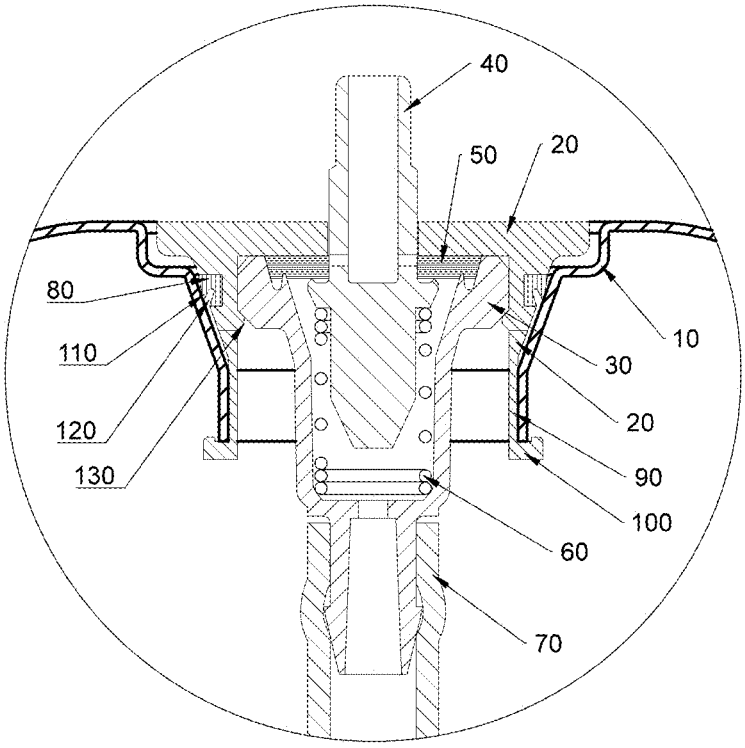
FIG. 3 shows a cross sectional view of the upper part of the aerosol container including the clincher containing clincher gasket and all components of the aerosol valve.
Figure 4:
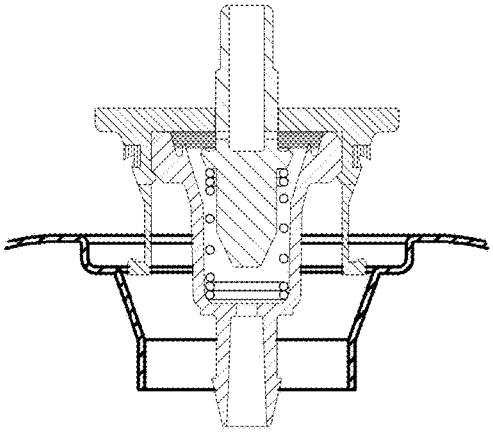
FIG. 4 shows a cross-sectional views of the upper part of the aerosol container in 3 segments: Position of the "Clincher" before entering the can opening, position of the "Clincher" during entering the can opening and "Clincher" position final when positioned into the aerosol container and ready for gassing.
Figure 4:
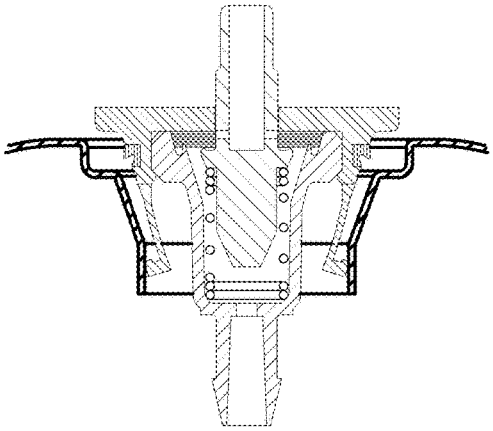
Figure 4:
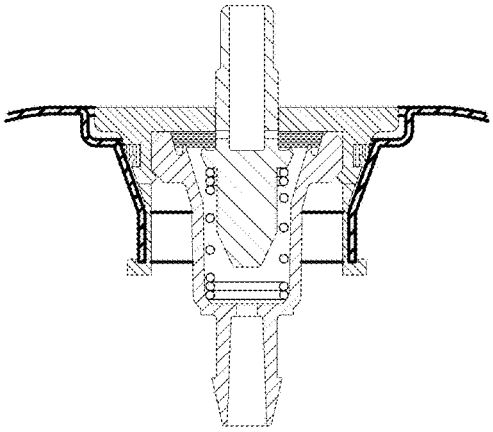
Figure 5:
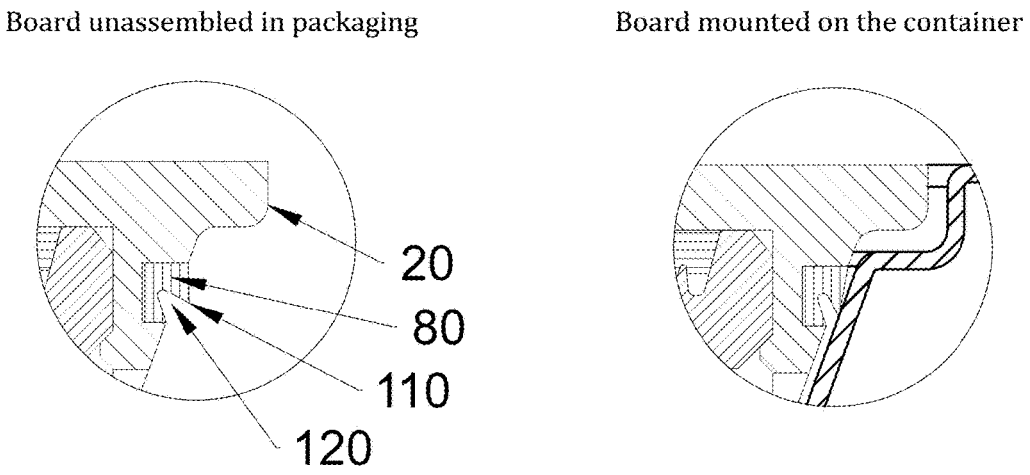
FIG. 5 shows a cross sectional view of the special gasket before mounting and when mounted into the inner hole of the can opening.

B) Clincher FIG. 2:

Todays dome closures are using mounting cups in which the valve with all his components is crimped into. The mounting cup is then crimped into the can dome opening, which is formed with a circumferential roll in order to give a better closing to the outer gasket mounted into the mounting cup or mounting cups produced out of laminated materials. Similar inventions also may use circumferential rolls to the inside of the can in which then a valve holder is located.

This invention is not depending of any circumferential rolls and the dome opening is just drawn to the inner side of the can ending with a sharp or rounded edge, in order to give the CLINCHER (20) a strong hold. The CLINCHER contains a conventional valve body (30) with the valve inserts stem (40), inner gasket (50), spring (60) and dip tube (70).

The CLINCHER (20) formed out of plastic material, contains two ore more flexible fingers. During the assembly process after filling the aerosol can with the dispensable goods and during the assembly process of pushing the valve into the upper can dome opening, the CLINCHER containing the valve will incline the fingers towards the inside of the CLINCHER, and will then be clicked onto the inner drawn part of the dome/aerosol can opening (10), fixing the finger supports (100) irrevocable to the can opening (see DGW 4).

The CLINCHER (20) itself is formed with a groove for the location of the EXTERNAL GASKET (80) and with two, eight (as shown on FIG. 2) or any other number of flexible fingers (90). The fingers (90) with their supports (100) on each of the fingers are located downwards into the aerosol can in order to be clicked into the upper dome opening of the aerosol can and giving the CLINCHER a strong hold against the future inner pressure of the can. The body (30) of the aerosol valve will be clicked, screwed or fixed into the CLINCHER (20).

Figure 6:
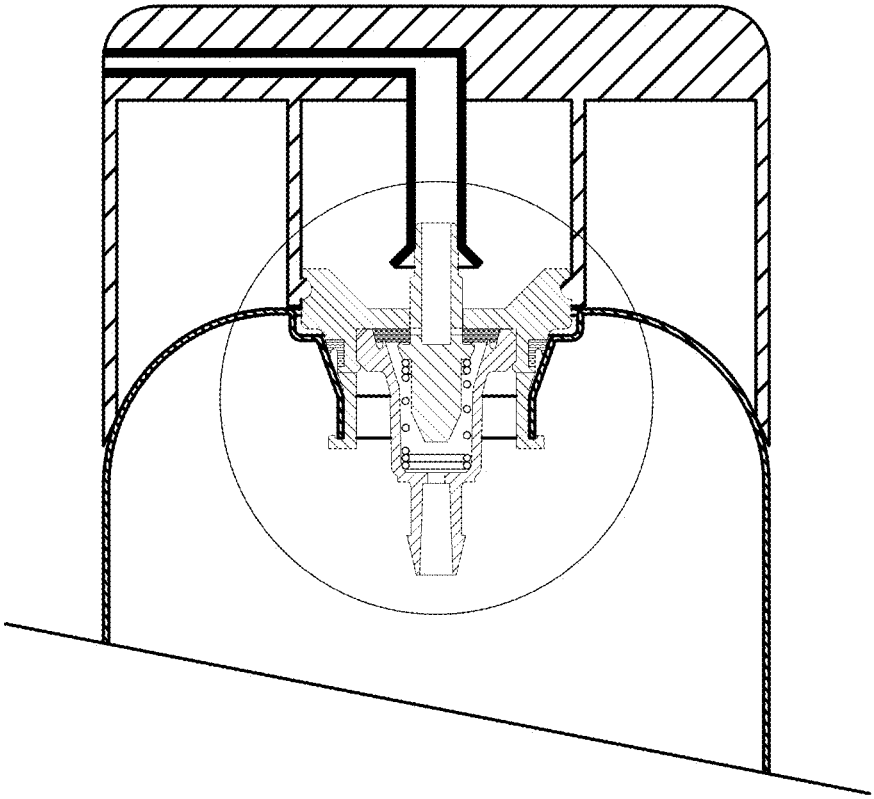
FIG. 6 shows only an idea, how an actuator cap can be mounted onto the "Clincher"
Figure 7:
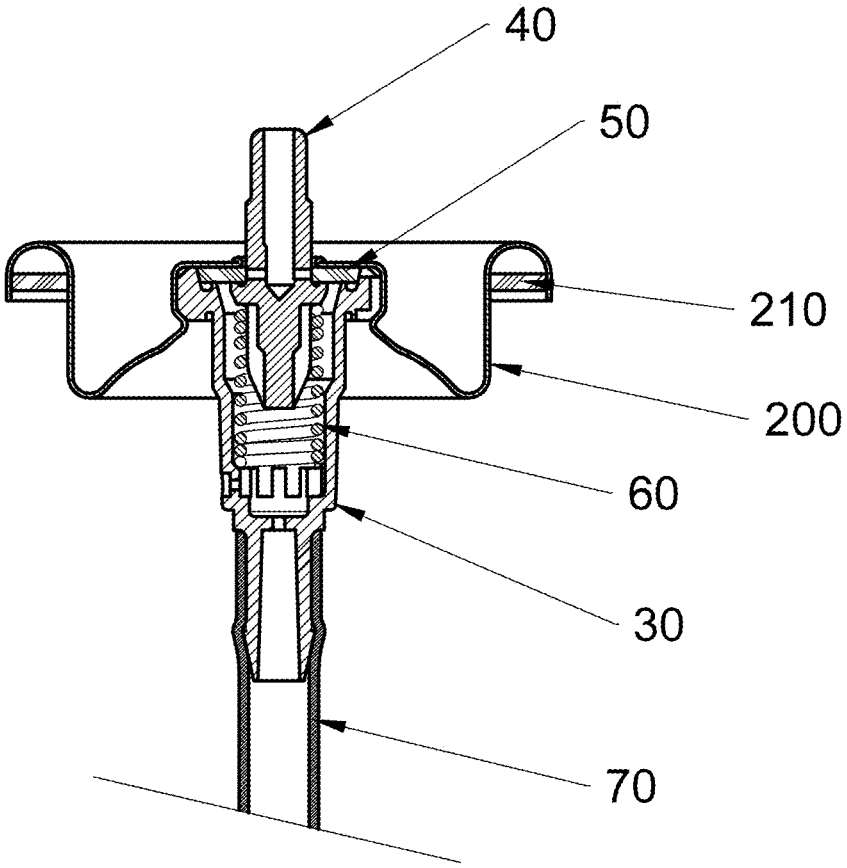
FIG. 7 shows a cross section few of a standard aerosol valve.

The upper part of the CLINCHER may also be designed as a spraycup/actuator holder in order to click on and hold a plastic actuator on the aerosol can. Only an example is shown in FIG. 6.

At the attached drawing the CLINCHER is round or circular. It may be made as well in any other form, like square, rectangular or others.

C) The EXTERNAL GASKET (80) already injected onto the CLINCHER (20) during or directly after the manufacturing process of the CLINCHER—or located into the CLINCHER in a 2nd operation—, allows the flow of the gas, air or other filling contents of the aerosol can only into one direction, downwards to the inside of the can. Once the pressurizing process is completed and the aerosol can is filled, the lip (110) of the EXTERNAL GASKET (80) returns to his natural position, stopping any losses of gas, air and/or other contents of the aerosol can.

The SPECIAL GASKET (80) is formed with an inner opening (120) and a gasket lip (110). During the gassing process, the gasket lip (110) moves by pressure of the gassing medium towards the inner opening (120), so the gassing medium passes by the inclined gasket lip. After completion of the gassing, the gasket lip (110) moves outwards, giving a closed fit toward the inner part of the aerosol can dome opening (10), securing that gas and other contents of the can remains inside the can. Due to this form of the gasket opening (120), the inside can pressure secures a close fit of the gasket lip (110) on the down drawn inner wall (10) of the can.

D) Pressurizing Process of Aerosol Cans:

In general there are three different pressurizing processes known in the aerosol industry.

The "cold" filling process, when the gas is frozen to liquid and filled into the can after the filling of the liquid content. Then the mounting cup is crimped to the can.

The second method, known as "Undercup" gas filling works in that way, that the prefilled can is gassed just lifting the mounting cup containing the valve, from the can dome opening and after gassing clinching the mounting cup onto the circumferential roll of the dome of the container. This filling method is still used in some locations with high gas losses to the environmental.

In order to solve these inconveniences, the third method of gassing was developed and is known as "pressurizing over the valve". That means, pressurizing is done through all the valve mechanism, with the valve already crimped onto the can and the can already filled with the product to be dispensed. Even this system is efficient concerning gas losses, this system stresses strongly the valve and limits seriously the flow speed of the pressurizing component. During the gassing process this may also cause damages to the valve itself, if not correctly assembled. Concerning to the speed limits during the gassing process, certain process parameters have to be considered, resulting in highly complex equipment, expensive and less efficient.

The CLINCHER (30) system with the EXTERNAL GASKET (80) will avoid all these problems. The new process uses the advantages of the high filling speed of the "Undercup system" (high gassing speed and not passing by the valve itself) and the best of the process "pressurizing over the valve" (low gas losses) in combination with a new design—with cost savings in his installation and machinery and raw materials (plastics instead of metal) and more efficient during the operation when filling more can containers per minute.

The pressurizing process will not be done through the valve. It only will be done with pressure to the external gasket (80), passing by the gasket lip (110), which is far less resistant as the whole valve mechanism. This secures a high-speed entry of the pressurizing components and finally a much more efficient system concerning productivity and investment of the equipment. The valve itself is not anymore limiting the speed during the pressurizing process.

E) Not Covered by this Invention:

In order to better understanding of the scope of this invention, the standard aerosol valve parts as: historic mounting cup & external gasket (200 & 210), stem (40), internal gasket (50), body (30), spring (60), and dip tube (70)

are not covered by this invention, due to the fact that they are components used during long time, and are registered in older patents.

Field of Usage of this Invention:

In general this invention is designed for the usage on any type of pressure filled aerosol cans with aerosol valves. This invention as well may be used for any system not pressurized and/or with internal pressure, just taking advantage of the use of the quick assembled clicked-in "Clincher" system.

Figure 8:
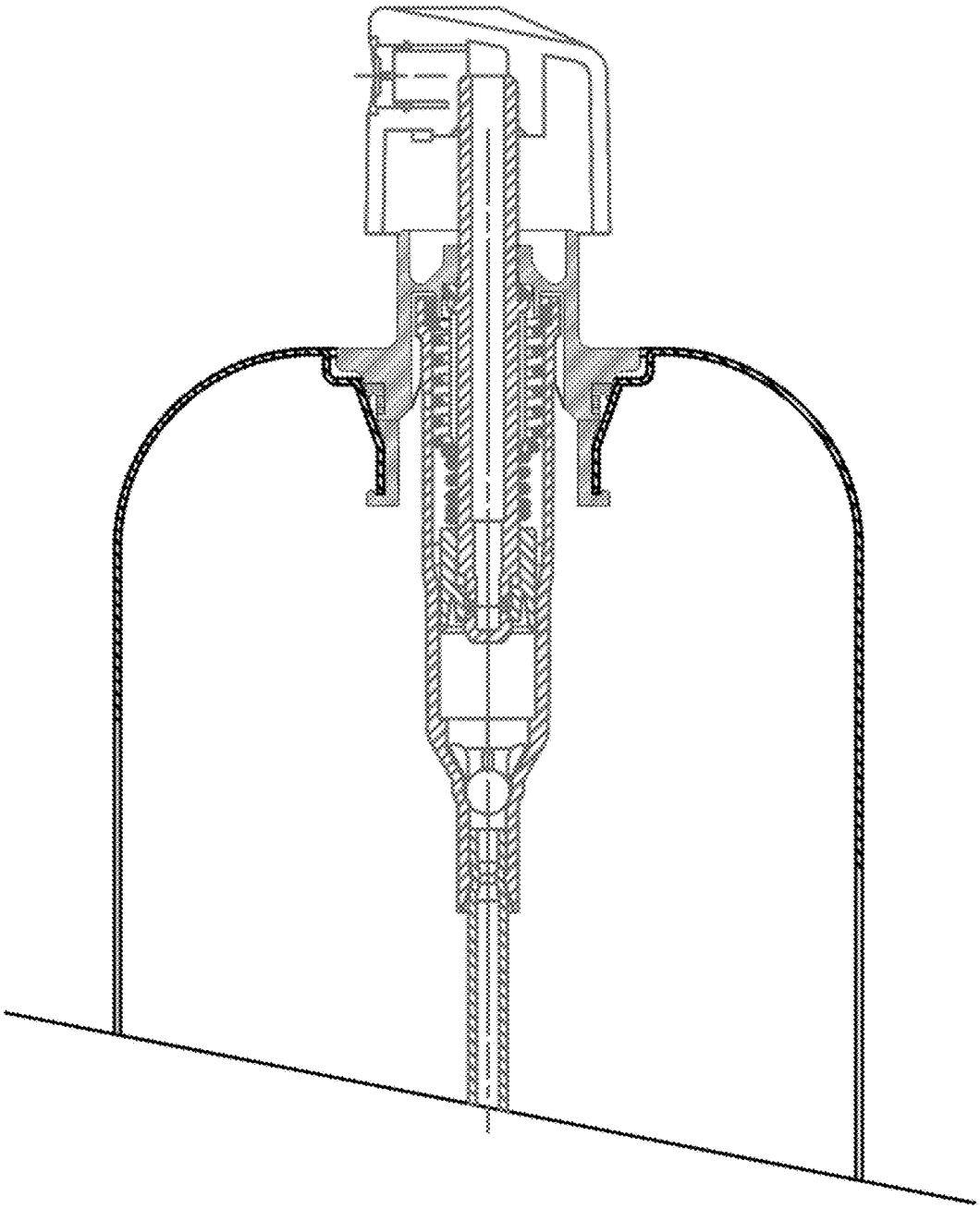
FIG. 8 shows an example of the clincher with a pulverizing pump

Only to mention an example, the system can be used for pulverizing systems with pulverizing or dosing pumps for cosmetic-, pharmaceutical and/or other usages. An example of the invention may be appreciated in FIG. 8.

The invention claimed is:

1. An aerosol container, comprising:

a container body having an opening extending toward an inside of the container, the opening having an edge; and a clincher to be fixed in the container body in a clicked-in manner, the clincher being received within the opening and comprising:

flexible fingers having supports on each of the flexible fingers, the flexible fingers configured to clamp around the edge of the opening;

an internal valve; and an external gasket configured to seal the inside of the container, the external gasket comprising a movable gasket lip and an inner opening.

2. The aerosol container according to claim 1, wherein the external gasket is configured to operate as a one way valve.

3. The aerosol container according to claim 1, wherein the external gasket is disposed within the container body below the opening of the container body.

4. The aerosol container according to claim 1, wherein the clincher further comprises a valve stem disposed inside the internal valve.

5. The aerosol container according to claim 4, wherein the clincher further comprises a spring surrounding a bottom portion of the valve stem inside the internal valve.

6. The aerosol container according to claim 4, wherein the clincher further comprises an inner gasket disposed between the valve stem and the internal valve.

7. An aerosol container, comprising:

a container body, comprising:

an upper edge;

an opening extending from the upper edge toward an inside of the container; and a bottom edge below the opening; and a clincher received within the opening and comprising:

flexible fingers having supports on each of the flexible fingers, the flexible fingers configured to clamp around the bottom edge;

an internal valve; and an external gasket configured to seal the inside of the container, the external gasket comprising a movable gasket lip and an inner opening.

8. A high speed gassing method of a container, the container comprising a container body having an opening extending toward an inside of the container, the opening having an edge; and a clincher to be fixed in the container body in a clicked-in manner, the clincher being received within the opening and comprising: flexible fingers having supports on each of the flexible fingers, the flexible fingers configured to clamp around the edge of the opening; an internal valve; and an external gasket configured to seal the inside of the container, the external gasket comprising a movable gasket lip and an inner opening, the method comprising:

filling propellant into the container only between walls of the container and the clincher, wherein the propellant passes through the external gasket and not through the internal valve.

* * * * *